US011352154B2

(12) United States Patent
Hoffman et al.

(10) Patent No.: US 11,352,154 B2
(45) Date of Patent: Jun. 7, 2022

(54) STRAPPING MACHINE WELDING HEAD WITH A BEVELED COUNTER-PRESSURE PLATE

(71) Applicant: Signode Industrial Group LLC, Glenview, IL (US)

(72) Inventors: Michael Hoffman, Bindlach (DE); Egmont Gollner, Hohenberg an der Eger (DE)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 16/992,883

(22) Filed: Aug. 13, 2020

(65) Prior Publication Data

US 2021/0094714 A1 Apr. 1, 2021

(30) Foreign Application Priority Data

Sep. 30, 2019 (DE) ..... 10 2019 215 010.1

(51) Int. Cl.
*B65B 13/32* (2006.01)
*B65B 13/04* (2006.01)

(52) U.S. Cl.
CPC ..... *B65B 13/32* (2013.01); *B65B 13/04* (2013.01)

(58) Field of Classification Search
CPC ..... B65B 13/06; B65B 13/08; B65B 13/184; B65B 13/186; B65B 13/22; B65B 13/24; B65B 13/32; B65B 13/00; B65B 13/04; B65B 61/02; B65B 11/10; B29C 65/7451; B41J 2/32
USPC ..... 53/399, 411, 131.2, 589
See application file for complete search history.

(56) References Cited

U.S. PATENT DOCUMENTS

| | | | | |
|---|---|---|---|---|
| 3,841,055 | A * | 10/1974 | Takami | B65B 13/32 53/589 |
| 4,776,905 | A | 10/1988 | Cheung et al. | |
| 6,003,438 | A | 12/1999 | Schwede | |
| 6,334,563 | B1 | 1/2002 | Schwede | |
| 6,405,917 | B1 * | 6/2002 | Mann | B23K 37/04 100/33 PB |
| 7,506,492 | B2 * | 3/2009 | Sauer | B65B 13/04 53/399 |
| 8,607,695 | B2 | 12/2013 | Schwede et al. | |
| 10,322,830 | B2 | 6/2019 | Hoehn et al. | |
| 2007/0181261 | A1 * | 8/2007 | Schmetzer | B29C 66/4322 156/583.1 |

FOREIGN PATENT DOCUMENTS

| | | |
|---|---|---|
| DE | 8430587 U1 | 1/1989 |
| DE | 3929710 C2 | 6/1993 |

(Continued)

OTHER PUBLICATIONS

Extended European Search Report pursuant to Rule 62 EPC, cited in European Patent Application No. 20195095.3. (6 pages), dated Feb. 15, 2021.

(Continued)

*Primary Examiner* — Anna K Kinsaul
*Assistant Examiner* — Himchan Song
(74) *Attorney, Agent, or Firm* — Neal, Gerber & Eisenberg LLP

(57) ABSTRACT

Various embodiments of the present disclosure provide a strapping machine welding head with a beveled counter-pressure plate.

12 Claims, 5 Drawing Sheets

(56) References Cited

FOREIGN PATENT DOCUMENTS

| | | | |
|---|---|---|---|
| DE | 9418542 | U1 | 1/1995 |
| DE | 202005016168 | U1 | 3/2006 |
| DE | 102009001544 | A1 | 10/2010 |
| EP | 0919468 | A1 | 6/1999 |
| EP | 3137381 | A1 | 3/2017 |
| EP | 3137381 | B1 | 3/2017 |
| JP | S48103983 | U | 12/1973 |
| WO | 9215486 | A1 | 9/1992 |

OTHER PUBLICATIONS

"Office Action", from corresponding German Patent Application No. 10 2019 215 010.1, with machine translation, dated Mar. 6, 2020.

* cited by examiner

STRAPPING MACHINE WELDING HEAD WITH A BEVELED COUNTER-PRESSURE PLATE

PRIORITY CLAIM

This patent application claims priority to and the benefit of German Patent Application No. 10 2019 215 010.1, which was filed on Sep. 30, 2019, the entire contents of which are incorporated herein by reference.

FIELD

The present disclosure relates to a welding head for a strapping machine, and particularly to a welding head with a beveled counter-pressure plate.

BACKGROUND

A strapping machine forms a tensioned loop of plastic strap (such as polyester or polypropylene strap) or metal strap (such as steel strap) around a load. A typical strapping machine includes a support surface that supports the load, a strap chute that defines a strap path and circumscribes the support surface, a strapping head that forms the strap loop and is positioned in the strap path, a controller that controls the strapping head to strap the load, and a frame that supports these components.

To strap the load, the strapping head first feeds strap (leading strap end first) from a strap supply into and through the strap chute (along the strap path) until the leading strap end returns to the strapping head. While holding the leading strap end, the strapping head retracts the strap to pull the strap out of the strap chute and onto the load and tensions the strap to a designated strap tension. The strapping head cuts the strap from the strap supply to form a trailing strap end and, with the leading and trailing strap ends overlapping one another, attaches the leading and trailing strap ends to one another to form a tensioned strap loop around the load.

Strapping heads typically include a welding head that attaches the leading and trailing strap ends to one another. Some welding heads include strap clamps to clamp the strap, strap manipulators to direct the strap, a strap cutter to cut the strap, a welder to weld the strap ends together, and a counter-pressure plate that can be inserted between the load and the overlapping strap ends to support and to allow for compression and heating of the overlapping strap ends during welding. One problem with existing counter-pressure plates is that they may contact the strap when moving into position before welding, which could damage the strap or displace the strap, leading to suboptimal welding or no welding at all.

SUMMARY

Various embodiments of the present disclosure provide a strapping machine welding head with a beveled counter-pressure plate that solve the above problems.

DETAILED DESCRIPTION

Figure 1:
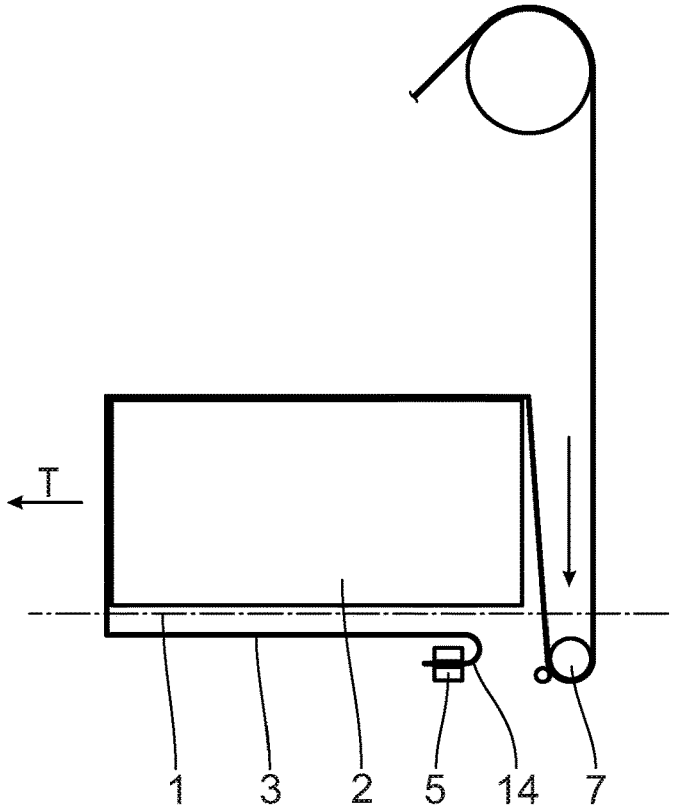
FIGS. 1-3 are diagrammatic views of one example strapping machine of the present disclosure at different points during a strapping operation.
Figure 2:
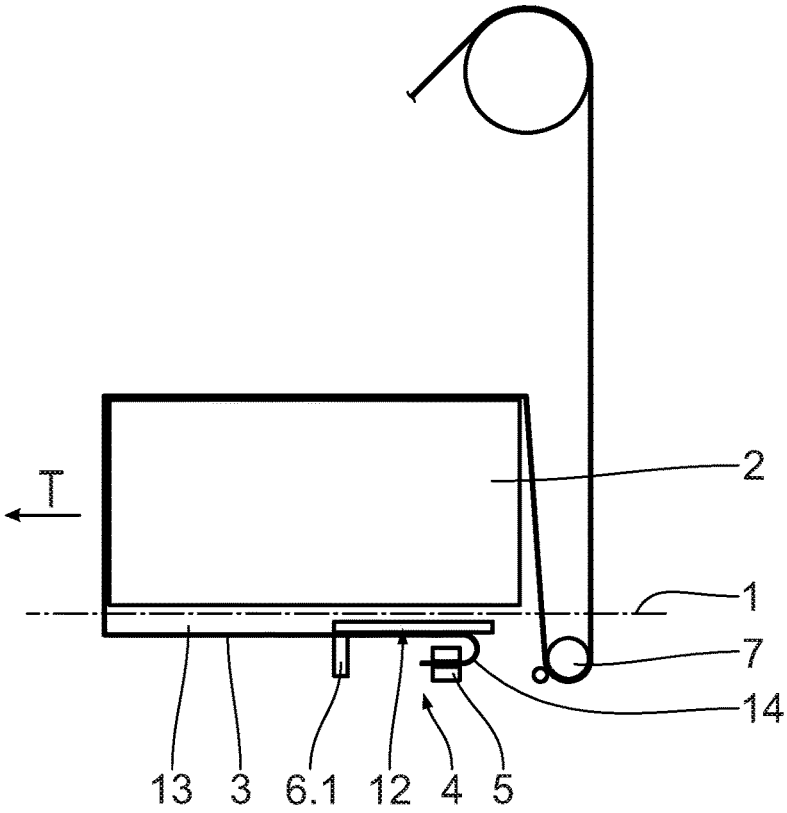
Figure 3:
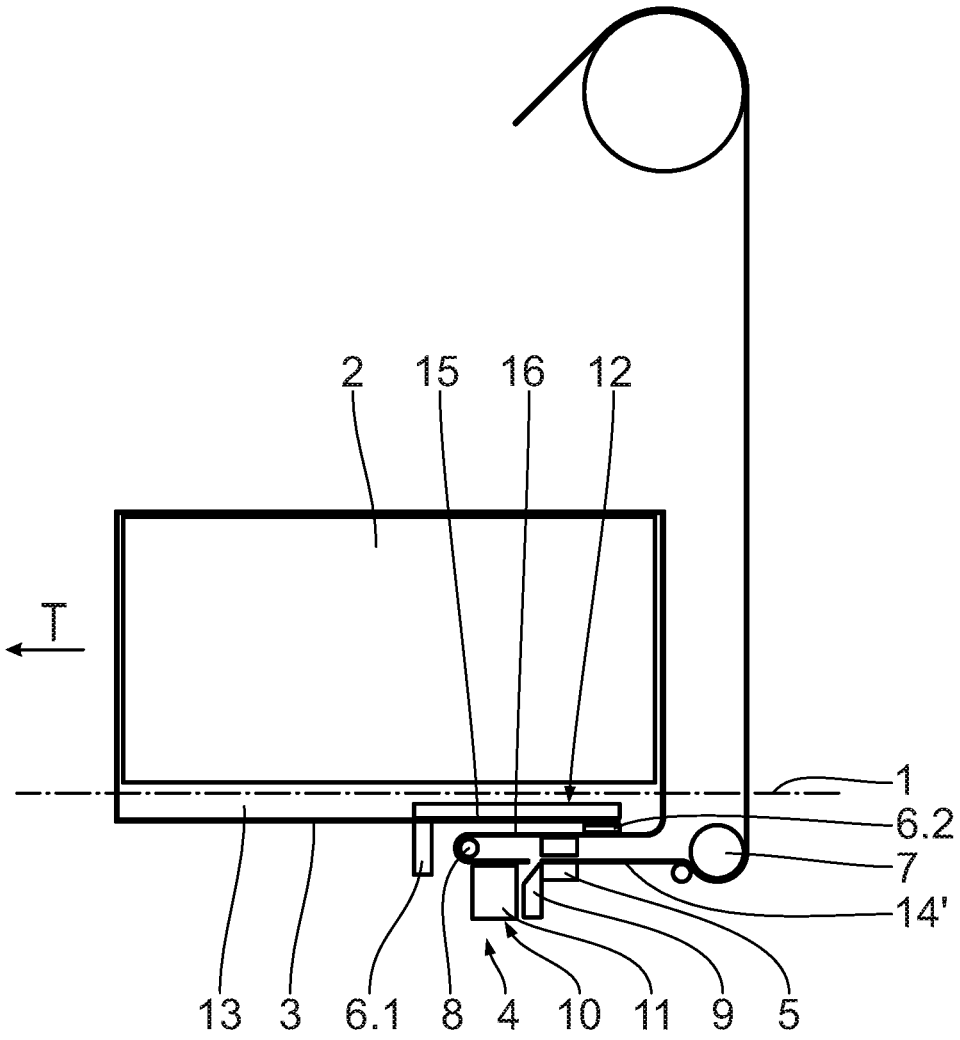
Figure 4:
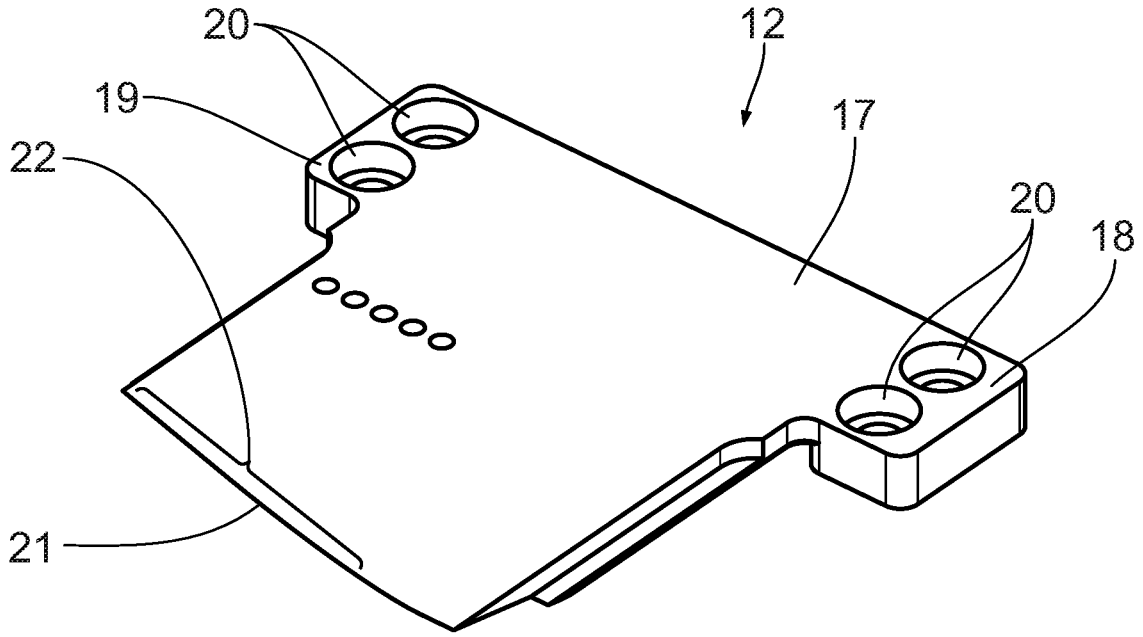
FIGS. 4 and 5 are perspective views of one example counter-pressure plate of a welding head of the strapping machine of FIG. 1.
Figure 5:
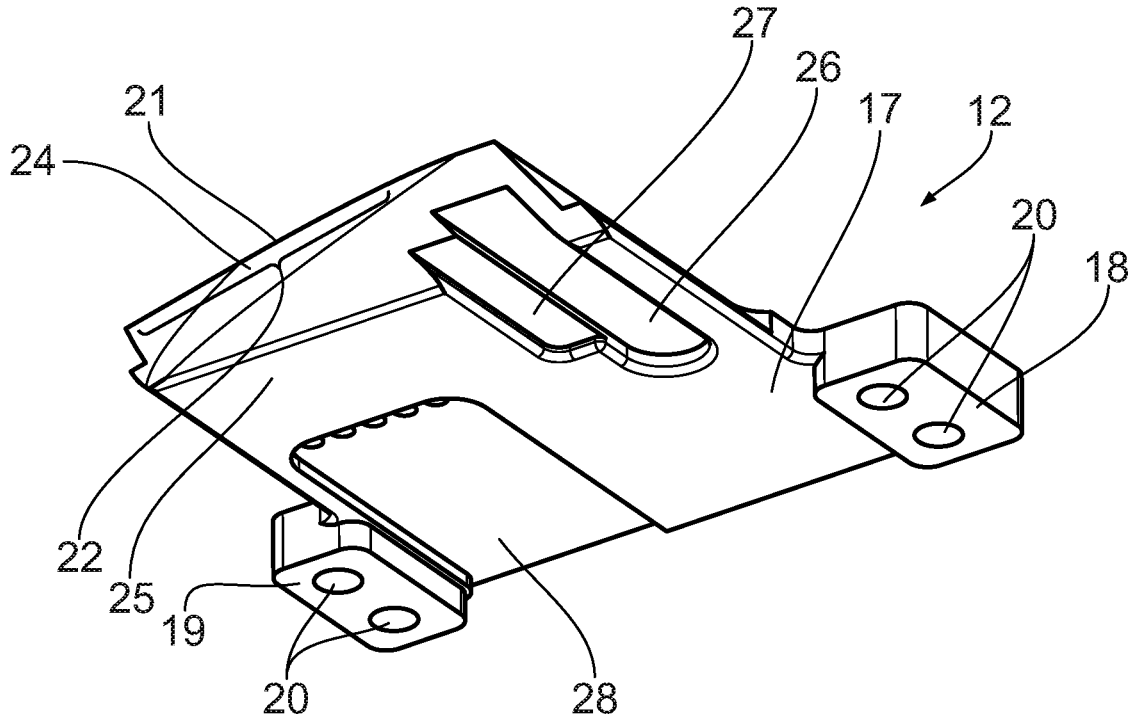

Basic components of a strapping machine will be outlined briefly with reference to FIGS. 1-3 by way of introduction to the description of the exemplary embodiment. The strapping machine shown has a working plane 1 (indicated in dotted lines) that (although not illustrated) comprises a work table with conveying devices integrated therein for conveying a load 2 to-be-strapped through the strapping machine in a conveying direction T. The work table also includes apertures for a strap 3. Arranged below the working plane 1 is a welding head 4 best shown in FIG. 3. The welding head 4 includes strap clamps 5, 6.1, and 6.2; strap manipulators 7 and 8; a cutting device 9; a welding device 10 having a welding jaw 11; and a counter-pressure plate 12. The interplay between these components and the overall functioning of the strapping machine is known in the art and omitted here for brevity.

Figure 6:
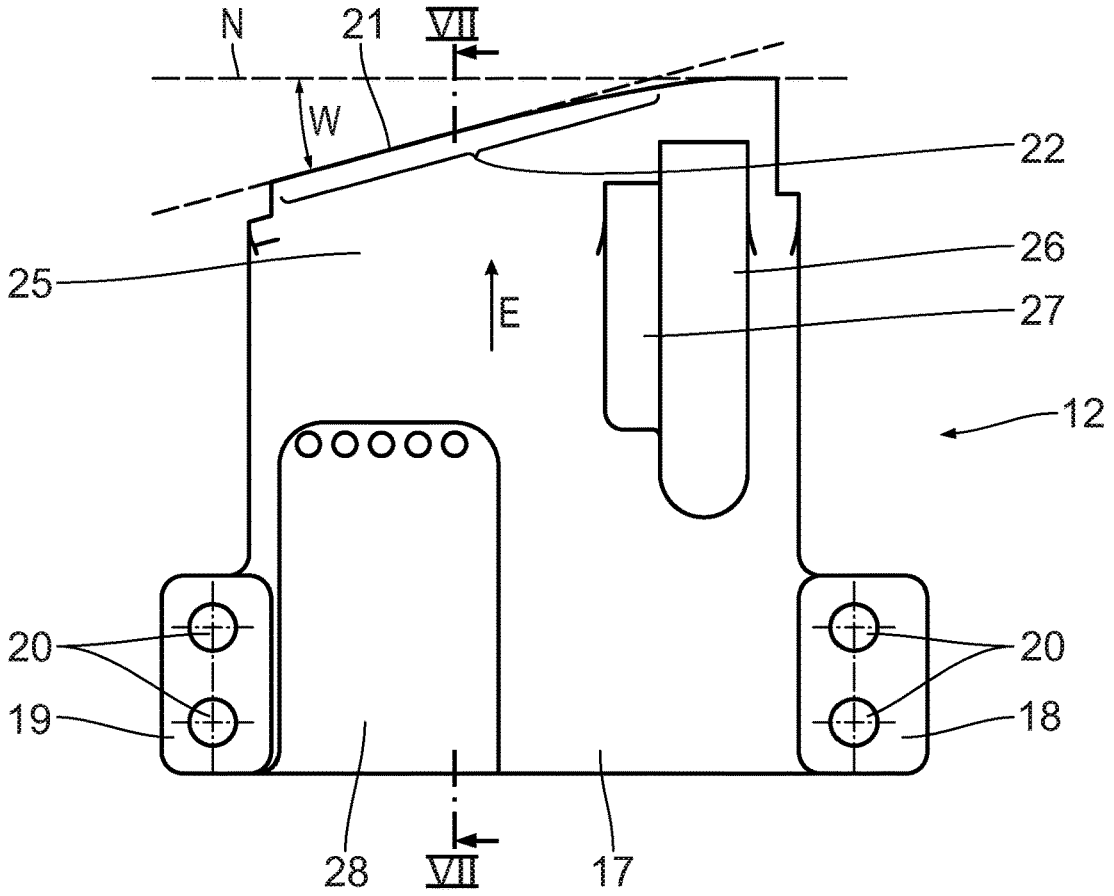
FIG. 6 is a bottom plan view of the counter-pressure plate of FIG. 4.
Figure 8:
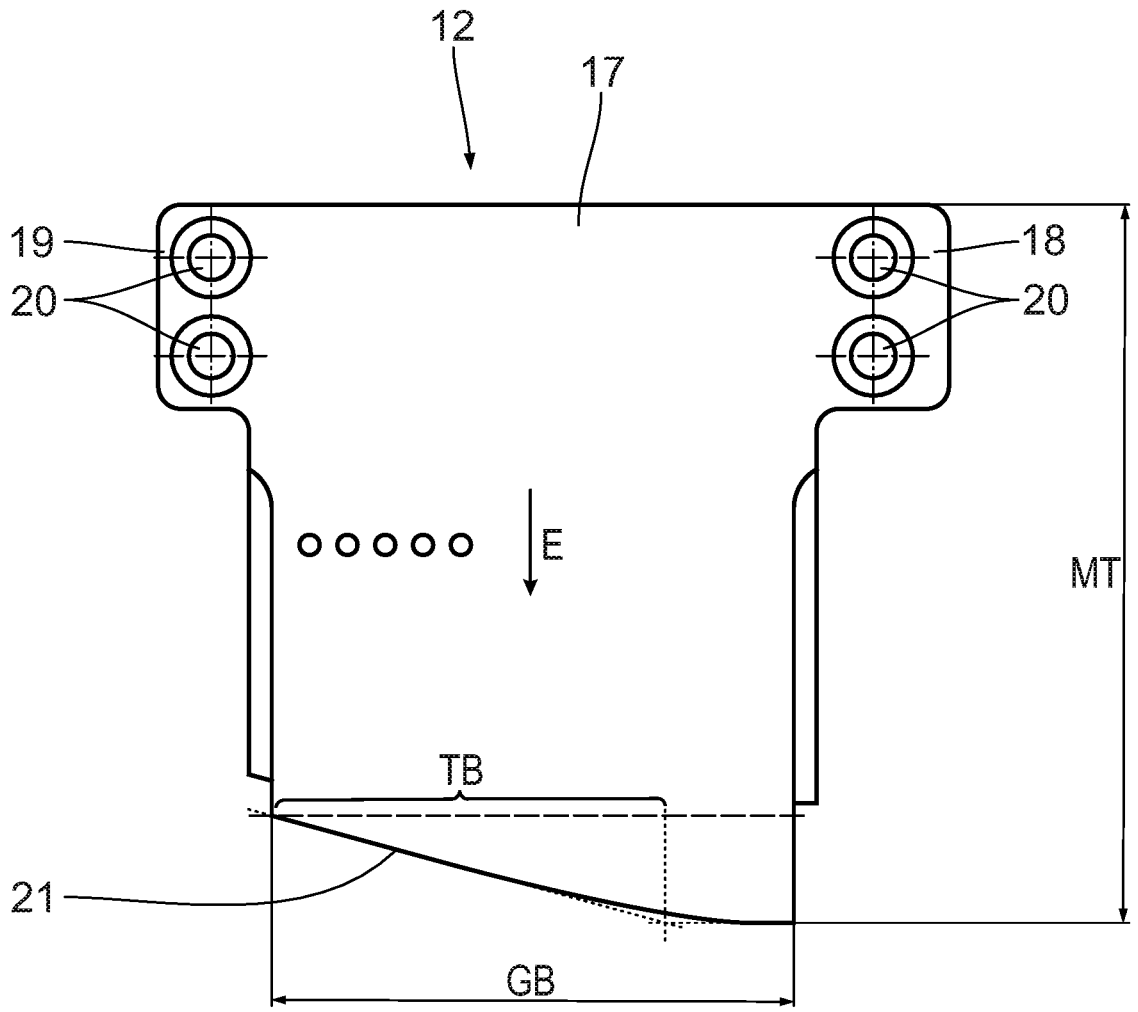
FIG. 8 is a top plan view of the counter-pressure plate of FIG. 4.

As shown in FIG. 2, relatively close to the start of the strapping process and after insertion of the load 2 into the suspended strap 3, the counter-pressure plate 12 is inserted in an insertion direction E (FIGS. 6 and 8) from the side (i.e., perpendicularly to the plane of the drawing in FIG. 2) into a clearance 13 between the working plane 1 and the strap 3. The configuration of the counter-pressure plate 12 (described below) enables the counter-pressure plate 12 to be inserted into the clearance 13 without requiring another strap manipulator to pull the strap 3 down and away from the working plane 1 before insertion to enlarge the clearance 13. Additionally, in the intermediate step shown in FIG. 2, the leading end 14 of the strap is still held by the strap clamp 5, and the strap 3 is furthermore fixed in the welding head 4 by the strap clamp 6.1 together with the counter-pressure plate 12 for the subsequent welding process.

Various manipulation processes known in the art take place in the welding head 4, thus giving rise to the intermediate configuration shown in FIG. 3. Here, the leading end 14 of the strap 3 has been released by strap clamp 5 and has been fixed against the counter-pressure plate 12 by the strap clamp 6.2. After guiding the strap 3 around the load 2, the strap manipulator 7 has moved the corresponding strap section between the strap clamp 5, which once again holds the strap 3 there. This section then represents the leading end 14' of the strap 3 for the next strapping process, and this is separated by the cutting device 9 from the strap 3 currently being processed. The now overlapping welding sections 15 and 16 of the strap 3 can then be welded to one another by the thermal and mechanical action of the welding jaw 11 while being held up by the counter-pressure plate 12, and in this way the strap loop around the load 2 can be closed. The counter-pressure plate 12 then moves sideways out of the clearance 13 again, the strap clamps 6.1 and 6.2 release the strap loop, the welding jaw 11 moves back, and the fully strapped load 2 can be moved out of the strapping machine 1 in conveying direction T.

The trouble-free insertion of the counter-pressure plate 12, which in this example embodiment is made from a metallic material such as chromium-molybdenum steel, is achieved via the particular shape of the counter-pressure plate 12, which is explained below with reference to FIGS.

4-8. The counter-pressure plate 12 has a generally rectangular main body 17 having a thickness D. The main body 17 is provided at its end facing away from the insertion direction E (in relation to the clearance 13) with two lateral assembly projections 18 and 19 that are thicker than the thickness D and that each define screw holes 20 therethrough. Although not explicitly indicated in the drawings, all the transitions between various edge sections of the counter-pressure plate 12 may be rounded. Moreover, the counter-pressure plate 12 defines various depressions 26, 27, and 28 to form free spaces for the engagement of various components of the welding head 4.

Figure 7:
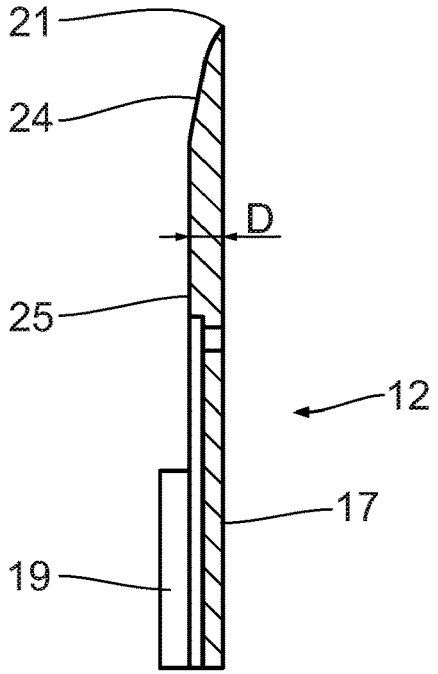
FIG. 7 is a cross-sectional elevational view of the counter-pressure plate of FIG. 6 taken along line VII-VII of FIG. 6.

The main body 17 has a front edge 21 that is in the lead during insertion. The front edge 21 includes a double bevel. More specifically, the front edge 21 has a slope 22 in that the front edge 21 runs towards the insertion direction E at an acute angle W of, for example, 10° to 20° (preferably about 15°) to the normal N over a partial width TB of, for example, 70% to 80% (preferably about 73%) of the total width GB of the main body 17. As is particularly apparent from the section shown in FIG. 7, a second bevel in the form of a thickness bevel 24 is provided in that the counter-pressure plate 12 tapers on one side from an underside 25 of the main body 17 towards the front edge 21 in the insertion direction E. This thickness bevel 24 extends over 10% to 20% (preferably about 15%) of the maximum depth MT of the main body 17.

The double bevel with (1) a slope of the front edge that deviates at an acute angle in the plane of the counter-pressure plate from the normal to the insertion direction (at least over a partial width) and (2) a thickness bevel due to a tapering run out in the thickness direction of the counter-pressure plate towards the front edge are particularly effective since the leading region of the counter-pressure plate, which is the first to enter the clearance during insertion, has an end face that is relatively narrow in the width and thickness directions. The front edge can therefore "slip into" the clearance, and if it touches the strap it moves the strap only slightly without damaging or misaligning it. By virtue of this configuration, the risk of the counter-pressure plate damaging or otherwise interfering with the strap during insertion is significantly reduced as compared to certain prior art counter-pressure plates, even if the clearance is narrow, thereby increasing reliability.

The invention claimed is:

1. A strapping machine for strapping a load, the strapping machine comprising:

a work table;

one or more strap manipulators;

a cutting device;

one or more strap clamps;

a welding device configured to weld overlapping sections of the strap to one another, and a counter-pressure plate movable in an insertion direction to position the counter-pressure plate between the load and the two overlapping portions of the strap, wherein the counter-pressure plate comprises a main body comprising a beveled front edge that comprises a first bevel that tapers an underside of the counter-pressure plate in the insertion direction such that a thickness of the main body decreases moving in the insertion direction toward the front edge, wherein the front edge of the main body has a width and a second bevel is sloped over at least part of the width such that an acute angle is formed between a sloped portion of the front edge and a direction normal to the insertion direction.

2. The strapping machine of claim 1, wherein the acute angle is 10 degrees to 20 degrees.

3. The strapping machine of claim 2, wherein the acute angle is about 15 degrees.

4. The strapping machine of claim 2, wherein the front edge of the main body of the counter-pressure plate is sloped over 70% to 80% of the width of the front edge.

5. The strapping machine of claim 4, wherein the front edge of the main body of the counter-pressure plate is sloped over about 73% of the width of the front edge.

6. The strapping machine of claim 1, wherein the front edge of the main body of the counter-pressure plate is sloped over 70% to 80% of the width of the front edge.

7. The strapping machine of claim 6, wherein the front edge of the main body of the counter-pressure plate is sloped over about 73% of the width of the front edge.

8. The strapping machine of claim 1, wherein the counter-pressure plate has a depth extending in the insertion direction and the taper extends over 10% to 20% of the depth of the counter-pressure plate.

9. The strapping machine of claim 8, wherein the taper extends over about 15% of the depth of the counter-pressure plate.

10. The strapping machine of claim 1, wherein the acute angle is 10 degrees to 20 degrees, wherein the front edge of the main body of the counter-pressure plate is sloped over 70% to 80% of the width of the front edge, wherein the counter-pressure plate has a depth extending in the insertion direction and the taper extends over 10% to 20% of the depth of the counter-pressure plate.

11. The strapping machine of claim 10, wherein the acute angle is about 15 degrees, wherein the front edge of the main body of the counter-pressure plate is sloped over about 73% of the width of the front edge, wherein the taper extends over about 15% of the depth of the counter-pressure plate.

12. A strapping machine for strapping a load, the strapping machine comprising:

a work table;

one or more strap manipulators;

a cutting device;

one or more strap clamps;

a welding device configured to weld overlapping sections of the strap to one another, and a counter-pressure plate movable in an insertion direction to position the counter-pressure plate between the load and the two overlapping portions of the strap, wherein the counter-pressure plate comprises a main body comprising a beveled front edge that comprises a first bevel that tapers an underside of the counter-pressure plate in the insertion direction such that a thickness of the main body decreases moving in the insertion direction toward the front edge, wherein the front edge of the main body has a width and a second bevel that is sloped over at least part of the width such that an acute angle is formed between the sloped portion of the front edge and a direction normal to the insertion direction, wherein the underside of the main body tapers in the insertion direction such that the thickness of the main body decreases across the entire width of the main body moving in the insertion direction toward the front edge.

* * * * *